United States Patent [19]

Kühn et al.

[11] 4,408,668

[45] Oct. 11, 1983

[54] IMPACT TRANSFER DEVICE FOR POWER RAMS

[75] Inventors: Hans Kühn, Hamburg; Arno Viecenz, Quickborn, both of Fed. Rep. of Germany

[73] Assignee: Koehring GmbH, Hamburg, Fed. Rep. of Germany

[21] Appl. No.: 234,942

[22] Filed: Feb. 17, 1981

[30] Foreign Application Priority Data

Feb. 20, 1980 [DE] Fed. Rep. of Germany ..... 3006234

[51] Int. Cl.[3] ..... B25D 17/06

[52] U.S. Cl. ..... 173/139; 173/128; 267/137

[58] Field of Search ..... 123/131, 132, 133, 139, 123/162 R, 128; 267/8 R, 137, 139, 140.1, 140.3, 140.4

[56] References Cited

U.S. PATENT DOCUMENTS

| | | | |
|---|---|---|---|
| 886,193 | 4/1908 | De Witt | 173/131 |
| 1,591,379 | 7/1926 | Hansen | 173/131 X |
| 1,954,070 | 4/1934 | Cook | 173/131 X |
| 3,866,692 | 2/1975 | Stelljes | 173/133 X |
| 4,043,405 | 8/1977 | Kuhn | 173/133 X |
| 4,121,671 | 10/1978 | West | 173/139 X |
| 4,187,917 | 2/1980 | Bouyoucos | 173/139 X |
| 4,262,755 | 4/1981 | Kuhn | 173/139 X |

*Primary Examiner*—James G. Smith
*Assistant Examiner*—Robert P. Olszewski
*Attorney, Agent, or Firm*—Michael J. Striker

[57] ABSTRACT

An impact transfer device for pile drivers is made as a one-piece steel unit defining a solid percussion part of a substantially cylindrical configuration with a convex impact surface capable of withstanding steel-on-steel impacts, an intermediate tubular part of substantially frusto-conical configuration integrally connected to the percussion part and a base ring integrally connected to the larger end of the intermediate tubular part having an annular support surface facing away from the impact surface.

27 Claims, 9 Drawing Figures

IMPACT TRANSFER DEVICE FOR POWER RAMS

BACKGROUND OF THE INVENTION

The present invention relates in general to power rams or pile drivers and in particular to an impact transfer unit made of steel and arranged between a hammer and a driven member to transfer impacts from the hammer body.

In prior-art ramming devices it has been known how to employ a percussion plate, a driving cap or the like between the drop hammer and the driven part in order to prevent deformation or damage of the latter. Such percussion plates or driving caps are provided usually with one or more inserts of a suitable buffer material capable of withstanding the extremely hard blows of the hammer. Such buffer means have included blocks or plates of hard wood, plastic, asbestos or aluminum, on the one hand, or layers of steel cables or cup springs, on the other hand. Due to the fact that such buffer materials, during the operation of the ram, are exposed to excessively large striking forces and sooner or later are destroyed and must be exchanged, there result inconvenient interruptions of the working process, timeconsuming auxiliary work and additional operational expenses. For this reason, impact transfer devices have been devised including a prestressed pressurized gas cushion enclosed in a cylinder under a movable striking piston. Such known impact transfer devices, however, due to the necessarily high prestressing forces and the resulting sealing problems, are complicated and expensive.

SUMMARY OF THE INVENTION

It is therefore a general object of the present invention to overcome the aforementioned disadvantages.

More particularly, it is an object of the invention to provide an improved impact transmitting device of the aforedescribed type which is not possessed of these disadvantages.

An additional object of the invention is to provide an improved impact transferring device which has a simple structure, is inexpensive to manufacture, and does not require for its operation exchangeable buffer means.

A further object of the invention is to provide such an improved impact transferring device which enables a non-destructive transfer of impacts from a hammer to a driven member.

In keeping with these objects, and others which will become apparent hereafter, one feature of the invention resides, in an impact transferring device of the aforedescribed type, in the provision of a driving cap made of steel and being formed of a solid percussion part of a substantially cylindrical configuration with a convex top surface capable of withstanding direct impacts of a steel hammer without the use of buffer means, of an intermediate tubular part of substantially frustoconical shape diverging from the bottom surface of the solid percussion part, and a reinforcing ring formed on the lower rim of the tubular part and defining an annular support surface for engaging the driven member. The driving cap of this invention is made as a one-piece unit and said parts are symmetrical about a center axis.

The particular construction of the impact transfer unit of this invention enables, apart from inexpensive manufacture, the elimination of the usual buffer means subject to fast disintegration during the operation of the ram, without permitting the striking forces from the ramming device or from the hammer of the ram against a driven member to impact so hard that damage of the driven member or of the ramming device would result. By virtue of the novel construction of the impact transfer device of this invention, the excessively steep and extremely short-lasting impact peaks occurring during a steel-on-steel hammer blow are so mitigated, and the time interval of the impact transfer is so extended, as to ensure, in combination, a driving moment which is sufficient for driving a pile or other driven part without causing any damage on the latter. In other words, the effect of the unit of this invention is to sufficiently limit the impact forces acting against a driven part of the power ram while extending the action of these forces. This effect in the unit of this invention is achieved by the particular configuration and mass distribution of its respective parts made as a single unit of steel and defining a particular ratio between the impact surface and the impact-transmitting surface. By suitably designing the shape of the cross-section of the device of this invention, an optimum resistance against bending can be achieved so as to withstand bending forces at asymmetrically introduced striking forces.

In driving tubular piles below water, during each hammer blow a volume of water contained in the interior of the tubular pile and corresponding to the advance of the pile has to be promptly expelled through suitable openings; in a modification of this invention the impact transfer device is designed such as to enable simultaneously a damping of the water impact.

In power rams for offshore pile driving in which a pile to be driven into the sea bottom is being guided through a plurality of annular pile guides, it is of advantage when the power ram or pile driver has a particularly slender configuration over which the diameter of the hammer housing corresponds to the diameter of the pile so that the pile driver could follow the pile through the annular guide. Since in this construction the pile driver cannot be equipped with a pile guiding face surrounding the head of the pile, the impact transfer device of this invention is with advantage provided with a guiding device arranged on the bottom surface of its reinforcing ring to engage positively the pile, thus making possible a connection resistant to bending in a direction transverse to the striking direction. In order to prevent that this guiding part attached as one piece to the driving cap to be accelerated at each stroke of the ram hammer, whereby the efficiency of the impact transfer is impaired, the guiding part is with advantage slidably guided in the opening of the reinforcing face ring of the cap, whereby the guiding part can be supported on the drive cap by means of shock-damping devices.

The impact transfer device of this invention is preferably a separate component part of the ram apart from the hammer and supported on the driven piece. In a modification, however, the impact transfer unit can be arranged on the hammer body in such a manner that the reinforcing base ring is attached to the hammer body or is integrally formed therewith and the impact surface during the operation faces and strikes the driven part or pile.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
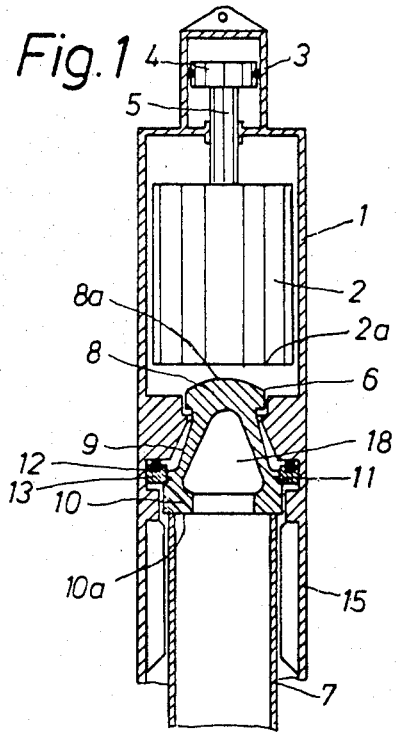
FIG. 1 is a schematic representation in a longitudinal section of a power ram containing the impact transfer unit of this invention.

The power ram or pile driver illustrated in FIG. 1 is constituted of a tubular hammer housing 1 in which a hammer body 2 is slidably guided for reciprocating axial movement. In this embodiment hammer body 2 is connected via a piston rod 5 to a piston 4 which in turn is movable in a separate cylinder 3 attached to the top end of the hammer housing 1. By feeding alternately a pressure medium into the spaces of the cylinder 3 above and below the piston 4, the latter together with hammer body 2 performs a reciprocating vertical movement during which the hammer periodically strikes against a driving cap 6 which is supported for a limited axial movement in the hammer housing 1 and rests upon the upper end of a tubular driven member 7. In this example, the driven member 7 is guided in a guiding jacket 15 attached coaxially to the lower part of hammer housing 1.

Driving cap 6 is formed as a one-piece steel part defining a solid percussion part of a substantially cylindrical configuration and having a convex impact surface 8*a* facing the hammer 2; an intermediate tubular part of a frustoconical shape diverging from the bottom surface of the solid percussion part; and a reinforcing base ring 10 formed on the lower rim of the tubular part 9 and resting with an annular support surface on the driven tubular part 7. The base ring 10 is formed with an annular outer shoulder 11 supporting an intermediate ring 13 and a damping element 12. The outer flange or shoulder 11 with elements 12 and 13 are limited in movement by juxtaposed stop surfaces of an inner groove in the hammer housing 1.

The impact surface of the cylindrical percussion part 8 of the driving cap 6 is formed with a convex impact surface 8*a* cooperating with the striking surface 2*a* of the hammer body 2. The intermediate tubular part 9 integrally connected to the percussion part 8 has a substantially frustoconical configuration diverging from the bottom surface of the percussion part 8 so that the bottom diameter of the part 9 exceeds the diameter of the part 8. At the same time, the wall thickness of the tubular part 9 decreases proportionally to the increase of its diameter so that the area of annular surfaces in the radial cross-section remains substantially the same over the height of the frustoconical part 9. The masses of the percussion part 8, of the tubular part 9 and of the base ring 10 are adjusted one to another in such a manner that the mass of the percussion piece 8, while exceeding the lower limit necessary for withstanding and transmitting the impact forces of the hammer body 2 and for guiding the hollow driving cap 6 in the hammer housing 1 is kept sufficiently small so that the force occuring when the large mass of the hammer 2 hits the relatively small mass of the percussion part 8 is kept relatively low, because to displace the percussion part 8 in the striking direction no large mass is initially to be set into motion, so that there is achieved a time-extended, blow-mitigating impact transfer without the occurrence of disruptive impact peaks. Whereas the entire mass of the driving cap 6 can be, according to the operational requirement, between 20 and 60%, and preferably between 30 and 45% of the mass of the hammer body 2, the mass of the percussion piece 8 amounts to between 25 and 45%, preferably between 30 and 40%, of the mass of the whole driving cap 6.

The curvature of the impact surface 8*a* for the sake of clarity is exaggerated in the drawing; in practice, the curvature of the convex surface 8*a* is dimensioned with respect to its diameter, as well as with respect to the diameter, the mass and the striking speed of the hammer 2, such that the radius of the elastic flattening occurring at an impact with maximum striking energy amounts at most to about 50%, preferably between 20 and 35% of the radius of the impact surface 8*a*. The radius of curvature of the impact surface 8*a* in most cases lies between 5-fold and 20-fold, preferably between 8-fold and 15-fold, diameter of the impact surface 8*a*. The radius of curvature need not necessarily be uniform over the entire impact surface. Particularly in the marginal area of the impact surface 8*a* it can be smaller than in the central range in order to avoid any formation of fissures of flakes.

In order to set the percussion part 8 in motion at an impact of the hammer body 2 in a desired manner by taking advantage of the time extension of the blow transfer resulting from the flattening of the convex impact surface 8*a*, the adjoining frustoconical tubular section 9 is to be designed as to its length, its angle of inclination with respect to the center axis, as well as regards its wall thickness decreasing proportionally to its increased distance from the percussion piece 8, in such a manner that upon the impact of the hammer it resiliently yields to the initial motion of the percussion part 8 but then creates a gradually increasing resistance which causes the common motion energy of the percussion part 8 and the hammer body 2 to be transmitted in a mitigated way to the base ring 10, wherefrom the blow is transferred in a non-destructive fashion onto the driven part 7. Since the intermediate conical tube 9 must possess elastic or resilient qualities, its wall thickness should be as small as possible, providing however, the strength required for withstanding the shock wave transmission. In case the elastic spring properties of the intermediate tubular part 9 are to correspond to a subproportional spring characteristic, this can be achieved by a suitable modification of the wall thickness.

The shock-mitigating effect of the diverging tubular part 9 is of particular importance when the convexity of the impact surface 8*a* is diminished due to the long operation of the pile driver or if it is necessary for some reasons to be designed relatively low. Under these circumstances, it is important for avoiding damage to intercept the hammer body 2 striking the percussion part 8 at a high velocity by the elastic conical tubular part 9 and the base ring 10 without excessively steep force peaks in a shock-mitigating fashion so that the steepness of the force peaks acting on the driven member 7 and the hammer 2 is sufficiently reduced and the duration of the blow transfer is correspondingly increased. Since the blow transfer from the percussion part 8 to the base ring 10 is in the form of a shock wave and the shock-mitigating effects resulting from the curvature of the impact surface 8*a* and the elastic properties of the tubular part 9 influence each other, there should not only the partial masses of the impact part 8, the tubular part 9 and the base ring 10, but also the masses of the entire driving cap 6, the hammer body 2 and the driven part 7 (or its head portion, especially in long, elastic driven parts) be considered in their mutual relationships. If these mass ratios correspond to the above-mentioned percentage ranges, and if each pile driver is adjusted to the size of the driven part and to the actual resistance of the ground, most favorable operational results of the pile driver are obtained.

Hollow space 18 enclosed by the conical tubular part 9 of the driving cap 6 can be utilized for damping water impacts when hollow piles are driven under water, whereby an improved efficiency of the impact transfer is achieved.

Figure 2:
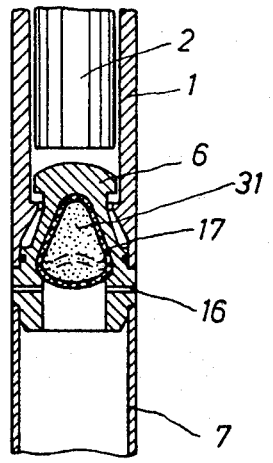
FIG. 2 is a longitudinal section of a modified version of the power ram with an impact or blow transfer unit.

In the embodiment illustrated in FIG. 2, driving cap 6 in the range of its base ring 10 is provided with radial channels 16 interconnecting the interior of the tubular driven part 7 to the outer environment. The power ram according to this embodiment has the so-called slim design without the use of the guiding case and the base ring of the driving cap 6 is formed with a downwardly converging conical ring for facilitating insertion and positive engagement of the driving cap with the driven part. A flexible, gas-tight envelope 17 containing a cushion 31 of pressurized gas is contained in the interior of the driving cap 6. The filling or discharging of gas into or from the envelope 17 is effected via non-illustrated valves. When due to an impact by the hammer body the tubular driven part 7 is driven by a certain increment into the sea bottom, for example, a corresponding section of water column present in the interior of the hollow driven part 7 is abruptly discharged through the radial channel 16 or similar openings in the wall of the diverging tubular part 7, the impact resulting from the slowness of the water displacement is elastically intercepted by the pressurized gas cushion 31 enclosed in the envelope 17.

Figure 3:
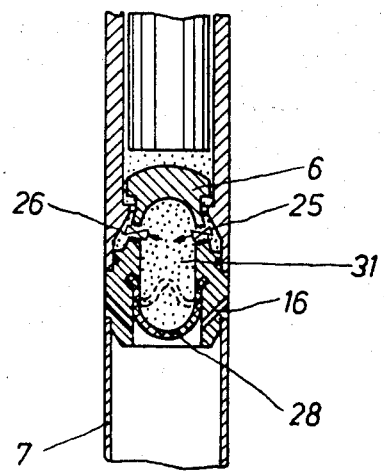
FIG. 3 is a sectional view of a cut away part of another embodiment of a power ram or pile driver with a blow transfer unit.

In the embodiment depicted in FIG. 3, the envelope 17 is substituted by an elastic diaphragm 28 clamped in a gas-tight fashion in the interior of the driving cap 6. The hollow space of the driving cap 6 containing the pressure gas cushion 31 communicates via non-return valve 25 and a discharge valve 26 with the space in hammer housing 1 in which the hammer body 2 is moving and which is filled with pressurized gas. Since during the operation of the pile driver under water the overpressure of gas medium in the hammer housing 1 is to be adjusted always to the depth at which the operation takes place, the cushion 31 of pressurized gas can be always complemented via the non-return valve 25 with gas from the hammer housing 1 to attain a pressure corresponding to the actual depth of immersion.

When the pile driver is being raised from its working position under water, gas from the gas cushion 31 is discharged via the valve 26 in accordance with the decreasing water pressure, so that the diaphragm 28 both during the actual working cycle as well as during the sinking and raising of the whole pile driver is always exposed to a pressure differential.

In the case of an operation in very deep water, there are necessary relatively large volumes of pressurized gas in the cushion to intercept impacts of the water column in the driven pile, and such increased cushions cannot be accommodated without additional measures in the limited hollow space 18 of the driving cap 6. It is possible to extend the driving cap 6 into the interior of the tubular driven part 7; nevertheless, such as extension has disadvantageous effects on the efficiency of the blow transfer because of the accompanying changes in the mass ratios of respective parts of the driving cap and because the extended part of the cap projecting into the interior of the driven part 7 does not participate in the actual blow transfer and must be uselessly accelerated during each hammer blow.

Figure 4:
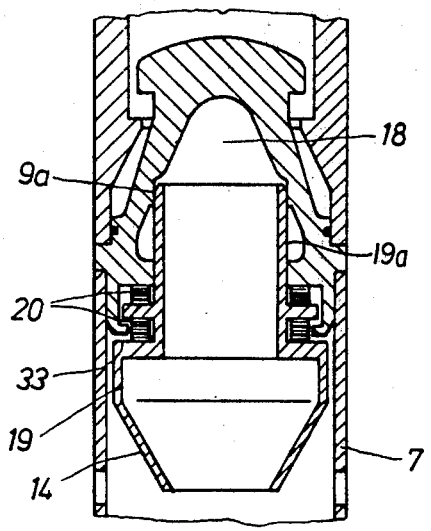
FIG. 4 is a view similar to FIG. 3 illustrating an impact transfer unit provided with a pile guiding member.

To avoid this disadvantage, the embodiment illustrated in FIG. 4 employs a separate guiding part 19 axially displaceable in the opening of the base ring 10. This guiding part 19 is formed with a substantially cylindrical guiding portion 19*a* enclosed in the interior of the driving cap and engageable at its top end with a guide surface 9*a* of the tubular part 9. To facilitate the insertion into the driven part 7, the portion of the guiding part 19 projecting from the base ring 10 has a substantially frustoconical shape 14 converging downwardly and having a base which exceeds in diameter the cylindrical part 19*a*. The step between the conical part 14 and the cylindrical part 19*a* of the guiding member 19 supports elastic shock-damping elements 20 abutting against annular bottom surface of the driving cap. Due to the elastic shock-damping elements 20, the separately movable guiding member 19 during the extremely short time interval of the blow transmission is practically without any substantial acceleration and therefore it can be positively guided in axial direction with bending-resistance against bending transverse to the axis of the driving cap. The tubular guiding member 19 is designed sufficiently large for enclosing a pressurized gas cushion of a volume which is suitable for operation even in very deep waters. In a pile driving operation outside water, the guiding member 19 can be simply removed, and consequently this modification provides an optimum adjustment for both modes of operation.

Figure 5:
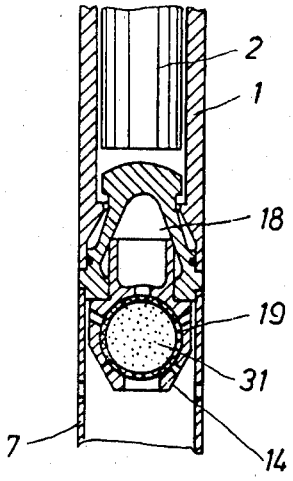
FIG. 5 is a view similar to FIG. 4 showing a modification of the guiding member.

In the embodiment illustrated in FIG. 5, the leading frustoconical part 14 of the guiding member 19 encloses a flexible envelope forming a pressurized gas cushion 31. The walls of the conical part 14 of the guiding member 19 are formed with a plurality of throughgoing passages directed radially toward the center of the cushion 31. Water column present in the tubular driven part 7 during each hammer blow is thus permitted to act against the spherical cushion 31 from different angles, thus damping the counteracting water blow in a more uniform manner.

Figure 7:
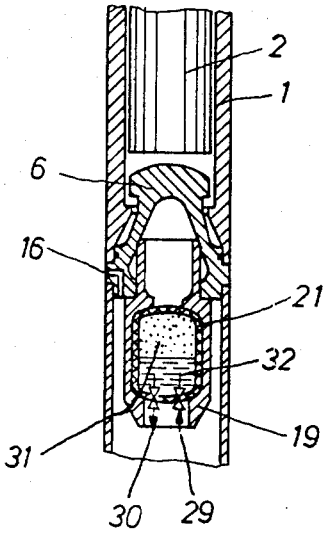
FIG. 7 is a view similar to FIG. 4 illustrating still another modification of the guiding member.

Since according to the present art the flexible envelopes used for enclosing the pressurized gas cushion 31 cannot be prestressed prior to the sinking of the driver to a pressure sufficient for very deep waters and the pressurizing of the gas cushion after submerging required to provide the pile driver pressurized gas vessels having automatically controlled valves for establishing the desired value of the overpressure according to the actual depth, both during the sinking of the driver and during the intermittent progress of the pile, in the embodiment shown in FIG. 7, the flexible envelope 21 contained in the guide member 19 is provided with an inlet valve 29 and an outlet valve 30. The envelope 21 prior to the immersion of the pile driver under water is filled with gas up to its permissible filling pressure limit. Upon the subsequent sinking of the pile driver into a water body in which at a certain depth the water pressure exceeds the gas pressure in the cushion 31, the biased inlet valve 29 opens and permits water to flow into the envelope 21 to further compress the enclosed pressurized gas cushion 31. It is true that in doing so the volume of the gas cushion 31 effective for intercepting the counterblows of the water column is reduced; nevertheless, the adjustment of the gas pressure in the cushion 31 to respective water pressures is accomplished. In order to neutralize the reduction of the volume of the gas cushion 31 due to the inflowing water and to ensure a sufficient intercepting effect against the water impact, the pressure gas cushion 31 is designed so as to define a larger starting volume, but such an enlargement is made possible without any additional measures due to the larger construction of the guiding member 19. In this way, even at an operation in deep waters, an effective damping of percussions of the water column in the tubular pile is effected, and no excessive compression is generated in the interior of the tubular pile 7. The blows of the hammer body are transmitted with a good efficiency even during the operation under water because no striking energy is dissipated for the useless compression of the water column in the driven part 7. In raising the pile driver in water, the corresponding decrease of water pressure in respective depth levels is matched by discharging water from the flexible envelope 21 through the outlet valve 30. To prevent pressure gas from escaping together with discharged water, the pressure gas volume in the flexible envelope 21 can be separated from the adjoining water by means of an additional, non-illustrated flexible envelope or diaphragm. In the latter case, pressure gas cushion 31 remains preserved, and no additional gas filling of the envelope 21 before the subsequent sinking of the pile driver is necessary.

Figure 6:
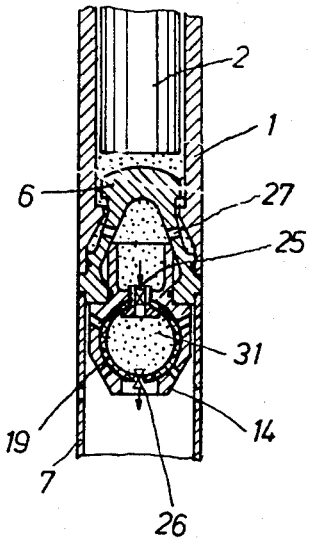
FIG. 6 is a view similar to FIG. 4 showing another modification of the pile guiding member.

When the space in hammer housing 1 accommodating the moving hammer body 2 is filled with gas charged at a pressure compensating the ambient pressure during an underwater operation, and thus avoiding the necessity of a pressure-resistant construction of the pile driver, it is also possible to use the pressurized gas in the housing 1 for replenishing the gas cushion 31. For this purpose, the embodiment illustrated in FIG. 6 is so designed that the inner space of the driving cap 6 enclosed by the conical tubular part 9 communicates via channels 27 with the gas-filled working space in the housing 1 enclosing the reciprocating hammer body 2. A non-return valve 25 arranged at the top part of the flexible envelope and leading to the gas-filled interior of the intermediate part 9 is automatically activated to admit pressurized gas from the housing 1 and the interior of the driving cap 6 into the air cushion 31 to adjust the gas pressure in the latter according to the pressure prevailing at particular water depths. In raising the pile driver in the water, pressurized gas in the cushion 31 is slowly discharged through the discharge valve 26 proportionally to the decreasing water pressure. The arrangement of the non-return valve 25 and of the discharge valve 26 permits the passage of the pressurized gas only in a predetermined direction. In addition, discharge valve 26 closes also in the case of a sudden pressure build-up in the envelope when the latter is compressed, for example by a water impact. The guiding member 19 in the embodiment according to FIG. 6 is guided in the driving cap 6 in a gas-tight manner.

Figure 8:
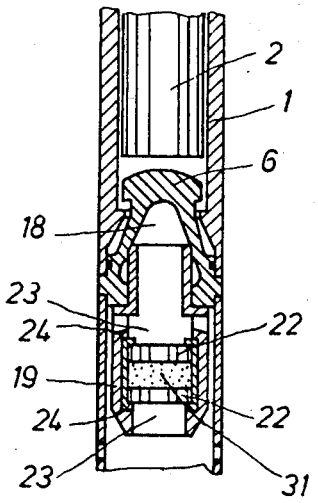
FIG. 8 illustrates in a sectional view an embodiment similar to that in FIG. 4 but provided with a pile guiding member having a separation piston.

Referring now to the embodiment of the impact transmitting device according to FIG. 8, pressure gas cushion 31 is arranged in a cylindrical space in the guiding member 19 between two axially movable pistons 22. Each of the pistons 22 is biased by the action of the pressurized gas cushion 31 against an assigned annular shoulder 24 in the wall of the cylindrical part of the member 19. Upon each impact of the water column in the tubular driven part 7 on the cushion 31, both pistons 22 are lifted from the supporting shoulder 24 so that the excessive water is momentarily intercepted. In this construction the biasing pressure of the gas cushion 31 can be substantially increased to limits permissible by the sealing technology in the pistons, and consequently the pile driver according to this embodiment is able to operate in water in a correspondingly increased depth. In a modification of this construction the pressure gas cushion 31 can be of course enclosed in a cylinder having a solid partition and a single movable piston 22 opposite this partition. In order to promptly intercept excessive water attacking upon each hammer blow, relatively large flow-through openings are necessary. Preferably, such openings 23 are formed opposite to each movable piston 22, and this arrangement can be made in several accumulating units arranged one after the other at predetermined intervals. The gas cushion 31, as mentioned before, can also be arranged in the hollow space 18 of the conical tubular part 9, whereby one of the pistons 22 is movable in a gas-tight manner in the opening of the base ring 10.

It will be understood that each of the elements described above, or two or more together, may also find a useful application in other types of constructions differing from the types described above, provided that the basic principle of this invention is maintained, that is, the percussive energy of the drop hammer is transmitted via a driving cap made of steel so that steel-on-steel impact takes place, whereby the configuration of the driving cap allows such a propagation of the impact energy that the blow is mitigated and extended in time.

Figure 9:
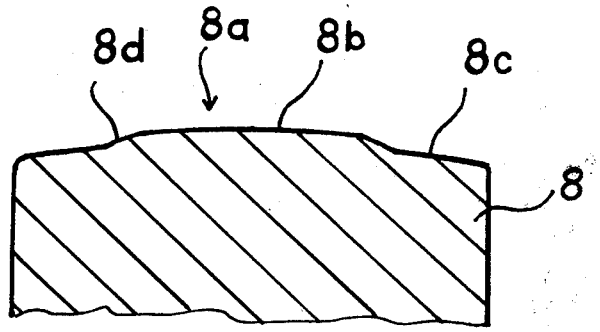
FIG. 9 shows in a cross-sectional view a configuration of the impact surface of the percussion part of the impact transfer device.

For example, as illustrated in FIG. 9, the impact surface 8*a* of the percussion member 8 can be shaped in such a manner as to exhibit a spherically convex central surface 8*b* and a spherically convex marginal surface 8*c* slightly offset backwards relative to the imaginary extension of said central surface by preferably about 0.2 to 2% of the diameter of the entire impact surface, and a rounded transition surface 8*d* arranged between the latter surfaces. This particular shape has the advantage that, in the event of an off-center impact of the hammer, the leverarm of the impact force is limited and the transverse load on the guiding devices for the impact transfer device and the hammer is kept small.

While the invention has been illustrated and described as embodied in a driving cap for a pile driver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adpat it for various applications without omitting features that, from the standpoint of prior art, fairly constitute essential characteristics of the generic or specific aspects of this invention.

What is claimed as new and desired to be protected by Letters Patent is set forth in the appended claims:

1. An impact transfer device for use between a hammer of a pile driver and a pile to be driven, comprising a solid percussion part having a substantially cylindrical configuration and a convex impact surface to be directly hit steel-on-steel by the hammer without interposed buffer means, an intermediate part in the form of a substantially frustoconical tubular piece diverging from that side of said solid percussion part facing away from said impact surface, and a reinforcing base ring formed on that end of said frustoconical tubular wall distant from said percussion part, said base ring having on its side facing away from said impact surface an annular support surface for unbuffered impact transmission to the pile.

2. An impact transfer device as defined in claim 1, wherein said convex impact surface of the solid percussion part has a radius of curvature, at least in the central range remote from the marginal area, between the 5-fold and the 20-fold diameter of the entire impact surface.

3. An impact transfer device as defined in claim 1, wherein the radius of curvature of the impact surface of said solid percussion part is dimensioned with respect to the hammer of said ram in such a manner that the radius of the elastically flattened portion occurring upon the impact of the hammer with its maximum striking energy does not exceed one half of the radius of the entire impact surface.

4. An impact transfer device as defined in claim 1, wherein the axial spacing between the percussion part and the annular support surface of said base ring is in the range of 2 to 4.5-fold average wall thickness of the intermediate tubular part of said cap.

5. An impact transfer device as defined in claim 1, wherein the angle of inclination of the wall of said intermediate tubular part is between 10° and 25°.

6. An impact transfer device as defined in claim 1, wherein the wall thickness of said frustoconical tubular piece continuously decreases toward the base ring.

7. An impact transfer device as defined in claim 6, wherein the wall thickness of said frustoconical tubular piece decreases proportionately to the increase of its diameter so that annular areas of respective radial cross-sections remain substantially the same.

8. An impact transfer device as defined in claim 1, wherein the mass of the device is between 20 and 60% of the mass of the hammer.

9. An impact transfer device as defined in claim 8, wherein the mass of the percussion part amounts to between 25 and 45% of the mass of the entire device.

10. An impact transfer device as defined in claim 1, wherein said base ring is formed with at least one channel for connecting the interior of a tubular driven member with the outer environment.

11. An impact transfer device as defined in claim 1, wherein said impact surface of said percussion part has a spherically convex central surface, a spherically convex marginal surface slighly offset backwards relative to the imaginary extension of said central surface and a rounded transition surface connecting said central and marginal surfaces.

12. An impact transfer device as defined in claim 11, wherein the diameter of said convex central surface corresponds at least to 40% of the diameter of the entire impact surface of said percussion part, and the annular marginal surface is offset about 0.2 to 2% of the diameter of the entire impact surface.

13. An impact device as defined in claim 1, wherein the surface portion of the side of said percussion part which is enclosed by said tubular piece is concave and continuously transitioning into the inner surface of said tubular piece.

14. An impact device as defined in claim 1, wherein said hammer is movable in a tubular hammer housing, and said base ring being provided with an outer shoulder for supporting said housing.

15. An impact transfer device as defined in claim 1 comprising a pile guiding member supported for axial displacement in the opening of said base ring and having a downwardly projecting part adapted for entering the interior of a hollow pile.

16. An impact transfer device as defined in claim 15, wherein said downwardly projecting part of said guiding member has a downwardly conically converging, frustoconical configuration with a base exceeding in diameter the opening of said base ring.

17. An impact transfer device as defined in claim 16, wherein said guiding member has a substantially tubular part projecting into the interior of said frustoconical tubular piece and an upwardly facing shoulder between said downwardly projecting part and said tubular part, said shoulder being engageable with a downwardly facing annular surface of said base ring.

18. An impact transfer device as defined in claim 15, further including a movable shut-off element for sealingly closing a hollow space in said frustoconical tubular piece to enclose in said space a pressurized gas cushion for damping strokes of a water column when the pile driver is operating under water.

19. An impact transfer device as defined in claim 18, wherein said shut-off element is in the form of a flexible envelope or of a diaphragm.

20. An impact transfer device as defined in claim 18, wherein said shut-off element is in the form of a cylinder-and-piston unit.

21. In impact transfer device as defined in claim 20, wherein said cylinder-and-piston unit includes a cylindrical part arranged in the downwardly projecting part of said pile guiding member and containing two juxtaposed pistons facing respectively the open top and bottom parts of said guiding member and adapted to enclose a pressurized gas cushion therebetween.

22. An impact transfer device as defined in claim 18, wherein said shut-off element is in the form of an envelope enclosed in the downwardly projecting part of said guiding member and being provided with an inlet valve openable at a predetermined outer pressure, and an outlet valve openable at a predetermined inner pressure.

23. An impact transfer device as defined in claim 18, formed with at least one throughgoing passage interconnecting its inner space with the working space of said hammer housing.

24. An impact transfer device as defined in claim 23, wherein the interior space of said guide member adapted to receive said gas cushion is connected via a non-return valve with the interior of said frustoconical tubular piece.

25. An impact transfer device as defined in claim 18, wherein said shut-off element is in the form of a diaphragm clamped in the inner wall of said tubular piece to enclose a pressurized gas cushion in the interior of said tubular piece, and further including a non-return valve passing through said tubular piece to admit gas from the working space of said hammer housing into the hollow inner space of said gap, and further including an outlet valve passing through said tubular wall to discharge gas at a predetermined overpressure from said cushion.

26. An impact transfer device as defined in claim 15, wherein said base ring is provided with an inner guide surface and the inner wall of said tubular part is provided with an annular guide surface at an axial distance from said base ring for guiding the tubular part of said pile guiding member.

27. An impact transfer device as defined in claim 26, wherein said guiding member is supported by said driving cap via shock-absorbing means.

* * * * *